US011223131B2

(12) United States Patent
Schühler et al.

(10) Patent No.: US 11,223,131 B2
(45) Date of Patent: Jan. 11, 2022

(54) ANTENNA DEVICE

(71) Applicant: Fraunhofer-Gesellschaft zur Förderung der angewandten Forschung e.V., Munich (DE)

(72) Inventors: Mario Schühler, Effeltrich (DE); Lars Weisgerber, Ebersbach-Neugersdorf (DE); Mengistu Tessema, Nuremberg (DE); Rainer Wansch, Baiersdorf (DE); Michael Schlicht, Seligenporten (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 455 days.

(21) Appl. No.: 16/151,674

(22) Filed: Oct. 4, 2018

(65) Prior Publication Data

US 2019/0044238 A1 Feb. 7, 2019

Related U.S. Application Data

(63) Continuation of application No. PCT/EP2017/058278, filed on Apr. 6, 2017.

(30) Foreign Application Priority Data

Apr. 7, 2016 (DE) ..... 102016205842.8
Apr. 29, 2016 (DE) ..... 102016207434.2

(51) Int. Cl.
*H01Q 9/04* (2006.01)
*H01Q 1/38* (2006.01)

(52) U.S. Cl.
CPC ..... *H01Q 9/0457* (2013.01); *H01Q 1/38* (2013.01); *H01Q 9/0435* (2013.01); *H01Q 9/0471* (2013.01); *H01Q 9/0414* (2013.01)

(58) Field of Classification Search
CPC ..... H01Q 9/04; H01Q 1/38
(Continued)

(56) References Cited

U.S. PATENT DOCUMENTS 8,643,556 B2 2/2014 Lindenmeier et al.
2003/0174098 A1 9/2003 Noro et al.
(Continued)

FOREIGN PATENT DOCUMENTS

DE 10 2010 035 934 A1 3/2012
DE 10 2012 101 443 A9 4/2014
(Continued)

OTHER PUBLICATIONS

Japanese Office Action dated Jan. 31, 2020, issued in application No. 2018-552833.
(Continued)

*Primary Examiner* — Andrea Lindgren Baltzell
(74) *Attorney, Agent, or Firm* — McClure, Qualey & Rodack, LLP

(57) ABSTRACT

The invention relates to an antenna device having an emitter element for emitting and/or receiving electromagnetic signals. The emitter element includes at least one coupling point connected to a side of the emitter element, and implemented for capacitively coupling electromagnetic signals in and/or out.

21 Claims, 12 Drawing Sheets

(58) Field of Classification Search
USPC ..... 343/700 R
See application file for complete search history.

(56) References Cited

U.S. PATENT DOCUMENTS

| | | | | |
|---|---|---|---|---|
| 2013/0141303 | A1* | 6/2013 | Huynh | H01Q 5/314 343/878 |
| 2014/0266963 | A1 | 9/2014 | Fasenfest | |
| 2014/0285382 | A1 | 9/2014 | Dobric | |
| 2015/0015447 | A1 | 1/2015 | Yona et al. | |
| 2015/0042513 | A1 | 2/2015 | Foo | |
| 2015/0214592 | A1* | 7/2015 | Peng | H01Q 9/0457 343/821 |

FOREIGN PATENT DOCUMENTS

| | | | | |
|---|---|---|---|---|
| JP | 2014534761 | T | 12/2014 | |
| WO | WO-2017186267 | A1 * | 11/2017 | H01Q 1/523 |

OTHER PUBLICATIONS

English translation of Japanese Office Action dated Jan. 31, 2020, issued in application No. 2018-552833.
European Office Action dated Nov. 4, 2020, issued in application No. 17716202.1.
International Search Report issued in application No. PCT/EP2017/058278 dated Jun. 21, 2017.
Written Opinion issued in issued in application No. PCT/EP2017/058278 dated Jun. 21, 2017.
F. Zhu et al.: "Ultra-Wideband Dual-Polarized Patch Antenna With Four Capacitively Coupled Feeds"; IEEE Transactions on Antennas and Propagation; vol. 32; No. 5; May 2014; pp. 2440-2449; XP011547190.
R. Soorya et al.: "UWB microstrip patch antenna with flower shaped patch and cavity structure"; 2016 International Conference on Wireless Communications, Signal Processing and Networking (WISPNET); Mar. 23, 2016; pp. 2080-2084; XP032959981.
A. E. Popugaev et al.: "A novel miniaturization technique in microstrip feed network design"; Proc. of the 3rd European Conference on Antennas and Propagation (EuCAP); Mar. 2009, pp. 2309-2313.
A. E. Popugaev et al: "A Novel High Performance Antenna for GNSS Applications"; Proc. of the 2nd Second European Conference on Antennas and Propagation (EuCAP); Nov. 11-16, 2007.
L. Weisgerber et al.: "Multibeam antenna array for RFID applications"; Proc. of the 2013 European Microwave Conference (EuMC); Oct. 2013, pp. 84-87.
Poynting Antennas (Pty.) Ltd., "Patch Antenna (Circular), 860-930 MHz, Product code: PATCH-A0003," Datasheet.
Poynting Antennas (Pty.) Ltd., "RFID Patch Antenna," http://www.poyntingcommercial.com/index.php?q=catalogue|productinfo,26.

* cited by examiner

ANTENNA DEVICE

CROSS-REFERENCES TO RELATED APPLICATIONS

This application is a continuation of copending International Application No. PCT/EP2017/058278, filed Apr. 6, 2017, which is incorporated herein by reference in its entirety, and additionally claims priority from German Applications Nos. DE 102016205842.8, filed Apr. 7, 2016, and DE 102016207434.2, filed Apr. 29, 2016, both of which are incorporated herein by reference in their entirety.

The invention relates to an antenna device. The antenna device serves, in particular, to transmit and/or receive electromagnetic signals.

BACKGROUND OF THE INVENTION

The ongoing reduction in size, or miniaturization, of electronic and electromechanical systems that is taking place eventually also causes the corresponding reduction in size of the components that may be used without losing any of its performance. On the contrary, an increase in the performance of said assemblies is strived for.

Additionally, there is an increasing demand for wirelessly communicating components and, therefore, there is an increase in the requirement placed upon the reduction in size of the antennas as main items of said assemblies. This constitutes one of the fundamental problems of miniaturizing systems since development of and, eventually, the dimensions of the antenna elements that may be used are subject to certain physical limits.

Depending on their shapes, sizes and feeding, antennas find their expression in different directional characteristics having different properties. There are a multitude of antenna shapes so as to do justice to the large number of requirements desired for the applications. In this context, energization, or coupling of the signal source to the emitter element plays a decisive part since in addition to the shape and size, the properties of the emitted wave and the base impedance of the antenna are decisively determined thereby. Such properties may include, e.g., the shape of the radiation lobe (beam), but also, in particular, polarization (linear, circular, elliptical), polarization purity (polarization decoupling), and omnidirectionality of the emitted free-space wave. Also, the impedance bandwidth and the frequency dependence of the directional characteristic are decisive factors in an antenna for broadband wireless communication. In order to generate, in different spatial directions, radiation lobes which are as even and extremely similar, e.g. for beamforming with group antennas, a high level of polarization purity as well as omnidirectionality of the directional characteristic of the individual element may be employed.

For many applications, e.g. with UHF RFID (ultra-high-frequency radio-frequency identification) reading ports, circularly polarized antennas are typically used so as to sense the passive transponders, which in most cases are linearly polarized, even in the event of highly different spatial orientations. To this end, multibeam antennas are increasingly employed so as to cover a larger range of angles, or space, by using a multitude of beam implementations. This enables reliably identifying a multitude of transponders, which are frequently arranged in bulk. In addition, such a multibeam antenna enables determining the spatial position (localization) of the transponders. For this purpose, highly even and symmetrical beams may be used whose production is possible only because of the above-mentioned emission properties of the individual elements of the array antennas.

For many applications, the antennas are desired to be low in cost. For example, in order to generate a circularly polarized directional characteristic at low cost, an emitter element (mostly in the form of a patch antenna) is coupled to feeding points offset by 90° (see, e.g., "Patch Antenna (Circular), 860-930 MHz" by Poynting Antennas (Pty. Ltd.). This is typically effected in a galvanic manner by means of wire lines below the patch. Here, a feeding network (mostly in microstrip line technology) may be used which enables a phase shift of 90° of the power supplied. However, the directional characteristic in this case has poor polarization purity, or cross-polarization discrimination (XPD), which results in asymmetric beams during beamforming. Also, this setup involves that the patch diameter be within the order of magnitude of half a wavelength and that a large ground surface area or a reflector may be used in order to keep back reflection (cross-polarization) low. The bandwidth of such a setup is also very small.

In order to be able to develop antennas having small dimensions while producing directional characteristics having high levels of polarization purity and omnidirectionality, ceramic antennas may be employed. However, they are very expensive and generally have very narrow bands. A more favorable method is to excite the emitter element at four feeding points offset by 90°, respectively [1]. In this context it is advantageous to use an emitter as a metal-sheet element having connection segments bent by 90° on the four sides and to directly solder them to the circuit board: feeding by means of wire elements is also feasible [2]. This involves a compact and decoupled feeding network [1], which provides the four phases offset by 90', respectively. By means of four-point feeding, the diameter of the emitter element may be reduced to clearly below half a wavelength while simultaneously achieving a high bandwidth. The bandwidth is slightly larger than with the two-point feeding solution. However, lossy stubs may be used for adapting the emitter and increasing its bandwidth. Moreover, a very large ground surface area as compared to the dimensions of the emitter element may be used in order to keep back reflection (cross-polarization) low. Also, as compared to the idea described, the emitter element exhibits a clearly larger electrical installation height.

A further possibility of coupling the patch element consists in coupling out the guided wave via slits in the ground surface area (see [3]). This involves a microstrip line crossing (in most cases orthogonally) the slit in the ground line. In order to enable circular polarization of the wave, the method of two- or four-point feeding may be applied here as well. For this purpose, a patch is not mandatory, but both cases will involve using a reflector so as to reduce back reflection and, consequently, to increase the gain. What is disadvantageous is that the dimensions of the oppositely located feeding points (slots) as well as the diameter of the patch amount to roughly half the wavelength of the signals emitted and/or received.

With the methods described, the dimensions of the emitter element and/or the distances of the feeding points are in the order of magnitude of half a wavelength. If said dimensions were reduced, the base impedances of the emitter element would clearly increase in terms of amount: the smaller the emitter element, the larger the amount of the base impedance. This renders impedance matching to 50 ohm or even 100 ohm more difficult and is generally associated with large power losses caused by the matching elements, and with a reduction in the bandwidth. As a result, low-loss matching of emitter elements, and/or with feeding-point distances which are clearly smaller than half the wavelength (e.g. a quarter of the wavelength), is almost impossible.

SUMMARY

According to an embodiment, an antenna device may have: an emitter element for emitting and/or receiving electromagnetic signals, wherein the emitter element includes at least one coupling point, the coupling point being connected to a side of the emitter element, and wherein the coupling point is implemented for capacitively coupling electromagnetic signals in and/or out.

The invention achieves the object by providing an antenna device comprising an emitter element for emitting and/or receiving electromagnetic signals. The emitter element comprises at least one coupling point. The coupling point is connected to a side of the emitter element. In addition, the coupling point is implemented for capacitively coupling electromagnetic signals in and/or out. In some of the following implementations, the coupling point is located directly on one side of the emitter element. Depending on the implementation, the side relates to the outer surface or outer border of the emitter element. In alternative implementations, the emitter element is extended, as it were, on the at least one side by an element—a blade element—which supports the coupling point. Depending on the implementation, the at least one coupling point is therefore directly or indirectly located—in particular via a blade element—on one side of the emitter element. The coupling point in this context is an area via which electromagnetic signals for emission are coupled into the emitter element or via which signals received from the emitter element are coupled out of the emitter element.

The antenna device in this context is an individual antenna or is part of several individual emitters and/or of an array antenna.

The emitter element is that part of the antenna device which serves to actually emit and/or receive the electromagnetic signals.

If the emitter element comprises the coupling point directly on its side, in one implementation a bridge element for capacitive coupling has an opening at the level of the side of the emitter element.

In one implementation, the antenna device comprises a conductive pattern for conducting electromagnetic signals. The conductive pattern and the emitter element are capacitively coupled to each other via the coupling point. The conductive pattern is formed, depending on the implementation, e.g. or electric lines or conductive tracks on a semiconductor substrate. The connection between the emitter element and the conductive pattern for transmitting the electromagnetic signals is effected in a capacitive manner and, in particular, in a manner that is free from galvanic coupling.

In one implementation, the emitter element comprises at least one blade element. The emitter element and the blade element are galvanically coupled to each other. Further, the blade element is arranged on the side of the emitter element. In addition, the emitter element and the blade element form an angle with each other, and the blade element comprises the coupling point. In this implementation, the coupling point is therefore located indirectly above the blade element on the side of the emitter element. Depending on the implementation, the emitter element and the blade element(s) are configured in one piece, or the blade element(s) is/are connected to the emitter element.

In one implementation, the blade element is made of an electrically conductive material, in particular a metal.

In one implementation, the antenna device comprises a carrier element. In one implementation, the conductive pattern is at least partly mounted on the carrier element. If in one implementation the conductive pattern at least partly consists of conductive tracks, said conductive tracks have been mounted and/or produced on the carrier element in a supplementary implementation. In one implementation, the carrier element is a substrate, for example, onto which the conductive pattern has been applied—e.g. by means of a thin-film or thick-film method.

In a further implementation, the blade element is angulated away from the emitter element in the direction of the carrier element. Thus, the blade element extends from the side of the emitter element in the direction of the carrier element. In addition, the coupling point is located at a free end of the blade element. The free end here is that end of the blade element that faces away from the side of the emitter element and, therefore, also from the emitter element. Thus, the free end is an end that is not connected to the emitter element.

In one implementation, the emitter element is connected to the conductive pattern or to other patterns in a capacitive manner only. In an alternative implementation, the emitter element comprises at least one galvanic coupling in addition to the at least one capacitive coupling.

In one implementation, an intermediate medium is located in the area of the coupling point, capacitive coupling being effected via the intermediate medium. In one implementation, the intermediate medium is a dielectric and, alternatively, at least a nonconductor, or insulator. The intermediate medium influences the type of coupling and, therefore, also the further electric properties of the antenna device. In a further implementation, the intermediate medium is mounted between two electrically conductive units, so that capacitive coupling results. Said two at least partly electrically conductive units are formed, in one implementation, by a blade element and a bridge element.

In one implementation, the emitter element is attached at a distance from the carrier element. In this implementation, the emitter element is located, e.g., above the carrier element. In one implementation, the distance also has an effect on the radiation properties of the antenna device. In one implementation, mechanical fastening and electric coupling of the emitter element are implemented by means of the same components (e.g. blade element and/or bridge element).

In one implementation, a distance between the emitter element and the carrier element is at least dependent on the blade element. In this implementation, the distance between the emitter element and the carrier element thus is dependent at least on the implementation on the blade element and, in particular, on its geometric design. In an implementation associated therewith, the blade element is at least part of a carrier structure which carries the emitter element and thus also keeps it at a distance from the carrier element.

In one implementation, the conductive pattern is mounted on the carrier element, so that in one implementation in combination with the previously indicated implementation, the emitter element is located, at a distance, above at least part of the conductive pattern. In this implementation, the conductive pattern thus is at least partly hidden and/or protected by the emitter element.

In a further implementation, the antenna device comprises at least one bridge element. The bridge element is galvanically or capacitively coupled to a feeding point of the conductive pattern. Moreover, the bridge element and the emitter element are capacitively coupled to each other via the coupling point. In this implementation, the conductive pattern comprises a feeding point where, thus, electromagnetic signals are coupled out of and/or into the conductive pattern. A bridge element is galvanically or capacitively coupled to said at least one feeding point. Eventually, the bridge element and the emitter element are capacitively coupled to each other via the coupling point. In one implementation, the bridge element and the blade element are capacitively coupled to each other. In one implementation, coupling between the conductive pattern and the emitter element is therefore indirectly effected via the bridge element and the blade element.

In one implementation, a distance between the emitter element and the carrier element depends at least on the bridge element. In this implementation, the bridge element thus at least partly serves also as a carrier element for the emitter element.

In one implementation, the emitter element is fixed, in relation to the carrier element, via the blade element or via the blade element and a bridge element. The blade element and/or the bridge element enable an electric—and specifically capacitive—connection between the emitter element and the conductive pattern. In this implementation, this is expanded by corresponding mechanical properties which enable the blade element and/or the bridge element to carry the emitter element and to thus keep it at a predefineable distance from the carrier element. Therefore, the distance between the emitter element and the conductive pattern, or specifically the carrier element—and any further components which may possibly be located thereon—may be set in a targeted manner via the blade or the bridge element or via the blade and the bridge element so as to achieve specific effects or properties of the radiation properties of the antenna device.

In one implementation, the emitter element is configured as a surface emitter (batwing radiator). A surface emitter differs from so-called linear emitters (or linear antennas) in that guided waves are transformed to free-space waves, and vice, versa, at a surface-area extension. For example, surface emitters are employed as directional antennas. The surface emitters are thus determined by a surface area which they span, or cover.

In one variant, the emitter element is configured as a surface emitter having an outer contour in the shape of an n-gon. n is a natural number larger than or equal to three. Therefore, in this implementation, the surface emitter has the outer contour of a triangle, of a quadrangle or of any other n-gon. The outer contour here relates, in one implementation, to the projection of the emitter element onto the carrier element and, in one implementation, therefore to the surface area covered by the emitter element. Therefore, in one implementation, at least one blade element is located, on the sides of the outer contour, between the corners in each case. In an alternative implementation, it is on at least one side that the blade element is located between two corners. The arrangement of the at least one coupling point or, depending on the implementation, of the at least one blade element is, in one implementation, at the center of the associated side.

In one variant, the emitter element is configured as a funnel-shaped surface emitter having a central dip. In this implementation, the emitter element is therefore not flat but comprises a dip which gives it its funnel shape. In one implementation, the emitter element is configured for the purposes of a horn antenna. In a further implementation, the emitter element has at least one recess within its outer contour.

If the emitter element is configured as an n-gon with n sides between the corners, one implementation provides for that the at least one coupling point is arranged in the area of a side of the n-gon of the emitter element. In one implementation, the coupling point is arranged centrally on a side of the n-gon. In a further implementation, n coupling points, each of which is arranged on one side of the surface emitter, exist to match the n-gonal emitter element.

In one implementation, the emitter element is configured as a metal sheet. A metal sheet here has an extension in terms of surface area that is clearly larger than its extension in terms of height. Moreover, the metal sheet advantageously consists of an electrically conductive metal or metal mixture.

In one variant, the emitter element is configured as a monopole. A monopole or a monopole antenna is part of a dipole antenna (or half-wave dipole antenna) as a linear antenna. Said antennas exhibit linear current distributions within the antenna structures. In practice, what is used, for example, is an electric conductor which is made of a metallic wire or of a metallic rod and is thin as compared to the wavelength. A monopole antenna (also referred to as a quarter-wave emitter or ground plane antenna) is an antenna rod, for example, which is reflected back, e.g., by an electrically conductive surface and thus results in a half-wave dipole. In an alternative implementation, the monopole is formed by a planar metal sheet, in which case the coupling point will be located above or below the face of the monopole.

In one implementation, the emitter element is configured as a rod-shaped monopole. In this context, the coupling point is located along a longitudinal axis of the rod-shaped monopole.

In one implementation, the antenna device comprises a ground surface area which in a further implementation is located on the carrier element. The ground surface area is connected to electric ground.

In one implementation, the emitter element has coupling points on several sides. In this context, the emitter element is capacitively coupled to the conductive pattern via at least one coupling point. In a further implementation, the emitter element is capacitively coupled to the conductive, pattern via more than one coupling point. In one implementation, the coupling points and/or the blade elements comprising coupling points are each located on the sides of an emitter element comprising an n-gonal outer contour.

In one implementation, the emitter element comprises four coupling points. In an implementation associated therewith, the emitter element is capacitively coupled to the conductive pattern via all four coupling points.

In a further implementation, the coupling points are arranged symmetrically around the emitter element.

In one implementation, the emitter element is connected to a signal source (e.g. in the form of a voltage source) via at least one coupling point. In one implementation, the signal source serves as a signal source for an electromagnetic signal which is emitted via the emitter element.

In an alternative or supplementary implementation, the emitter element is coupled to an open circuit via at least one coupling point. Coupling via the coupling point is effected in a capacitive manner in each case. In the case of the open circuit, therefore, no coupling to a load or an electric resistor is provided via the coupling point. Therefore, there is an open end.

In a further alternative or supplementary implementation, the emitter element is connected to a short circuit via at least one coupling point.

In one implementation, there are at least two emitter elements. In a further implementation, said at least two emitter elements are coupled to each other—in particular in a capacitive manner or via a short circuit, i.e. in a galvanic manner.

One implementation provides for the two emitter elements to have different distances from the carrier element. The emitter elements are mounted at different heights. In one implementation, the emitter elements overlap—e.g. in the projection perpendicular to the carrier element—and are free from overlap in an alternative implementation.

In one implementation, one of the two emitter elements comprises a recess located, e.g., centrally within the emitter element configured as a surface emitter. In a further implementation, the other emitter element is arranged in the area of the recess. In one implementation, an emitter element corresponds to the recess of the other emitter element and is located, in one implementation, by way of supplementation to the former, at a different height than the correspondingly associated recess. Thus, in the latter implementation, part of an emitter element has been displaced in terms of height, as it were. Advantageously, the two emitter elements are capacitively coupled to each other.

In a further implementation, the emitter element has at least one angular deflection. In this implementation, the emitter element is configured to be rather rod-shaped, for example, or as a rather planar element and has an angulated or bent shape at at least one point.

The inventive antenna device thus results in the advantages that the dimensions of the antenna device are reduced while no or only minor losses in terms of performance, e.g. radiation behavior with simultaneous impedance matching, are entailed. In particular, radiation properties and impedance matching may be predefined and/or set in a targeted manner via the type of capacitive coupling and the components involved.

In particular, there are a large number of possibilities of implementing and further developing the inventive antenna device. In this respect, reference shall be made to the claims, for one thing, and to the following description of embodiments in connection with the drawing, for another thing.

BRIEF DESCRIPTION OF THE DRAWINGS

Embodiments of the present invention will be detailed subsequently referring to the appended drawings, in which.

DETAILED DESCRIPTION OF THE INVENTION

The present invention essentially includes an antenna element—specifically an emitter element—as part of the antenna device 1, which antenna element is fed via a novel capacitive form of coupling. Thus, the diameter may be reduced to clearly below half a wavelength of the electromagnetic signals to be emitted and/or to be received, while enabling lossless, or low-loss, impedance matching to clearly below 100 ohm, e.g. 50 ohm. Depending on the implementation, this is successful up to a quarter of the wavelength and below. In this context, it is also possible to dispense with the lossy matching elements, which in conventional technology have been used for matching emitters of less than half a wavelength. In addition, no large ground surface area and no reflector are necessary for suppressing the back reflection. As a result, the efficiency of the emitter element 4 in total is clearly reduced in conventional technology.

The antenna device 1 is implemented, by way of example, for operation at 910 MHz, With exemplary dimensions (a square carrier element having an edge length of 175 mm, and a square emitter element having an edge length of 75 mm) and a height of 30 mm, the real part of the base impedance in the event of a purely galvanic coupling amounts to approx. 200 ohm.

Figure 1:
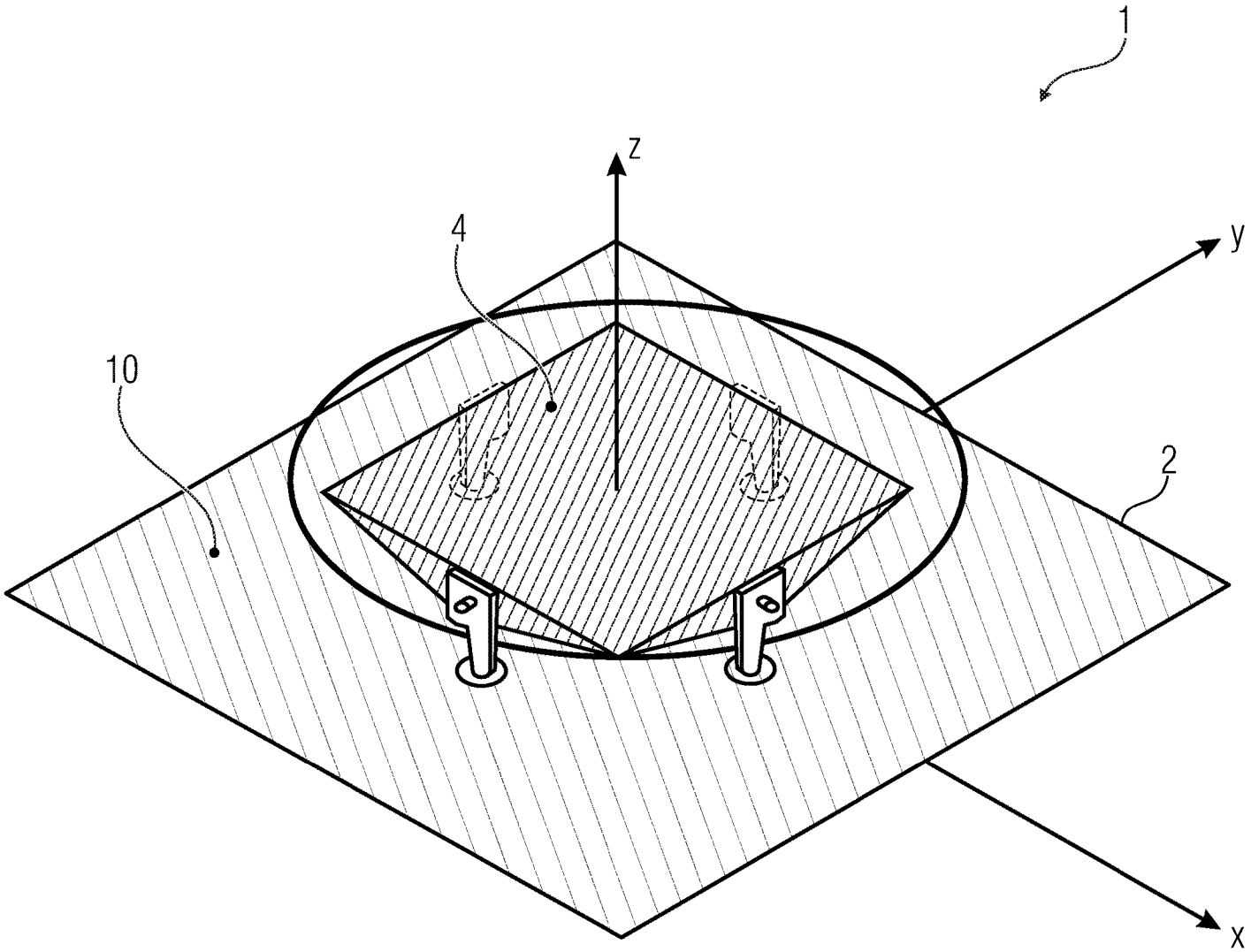
FIG. 1 shows a spatial and partly transparent representation of a first implementation of an antenna device.

FIG. 1 shows a spatial representation of an antenna device 1 comprising a carrier element 2 and an emitter element 4. A ground surface area 10 is also located on the carrier element 2 here. It can be seen that the emitter element 4 has a quadrangular outer contour and exhibits a funnel-shaped dip. In total, the emitter element 4 is spaced apart from the carrier element 2 and is held, or carried, here by the four coupling points and/or by the four blade elements 6.

Figure 2:
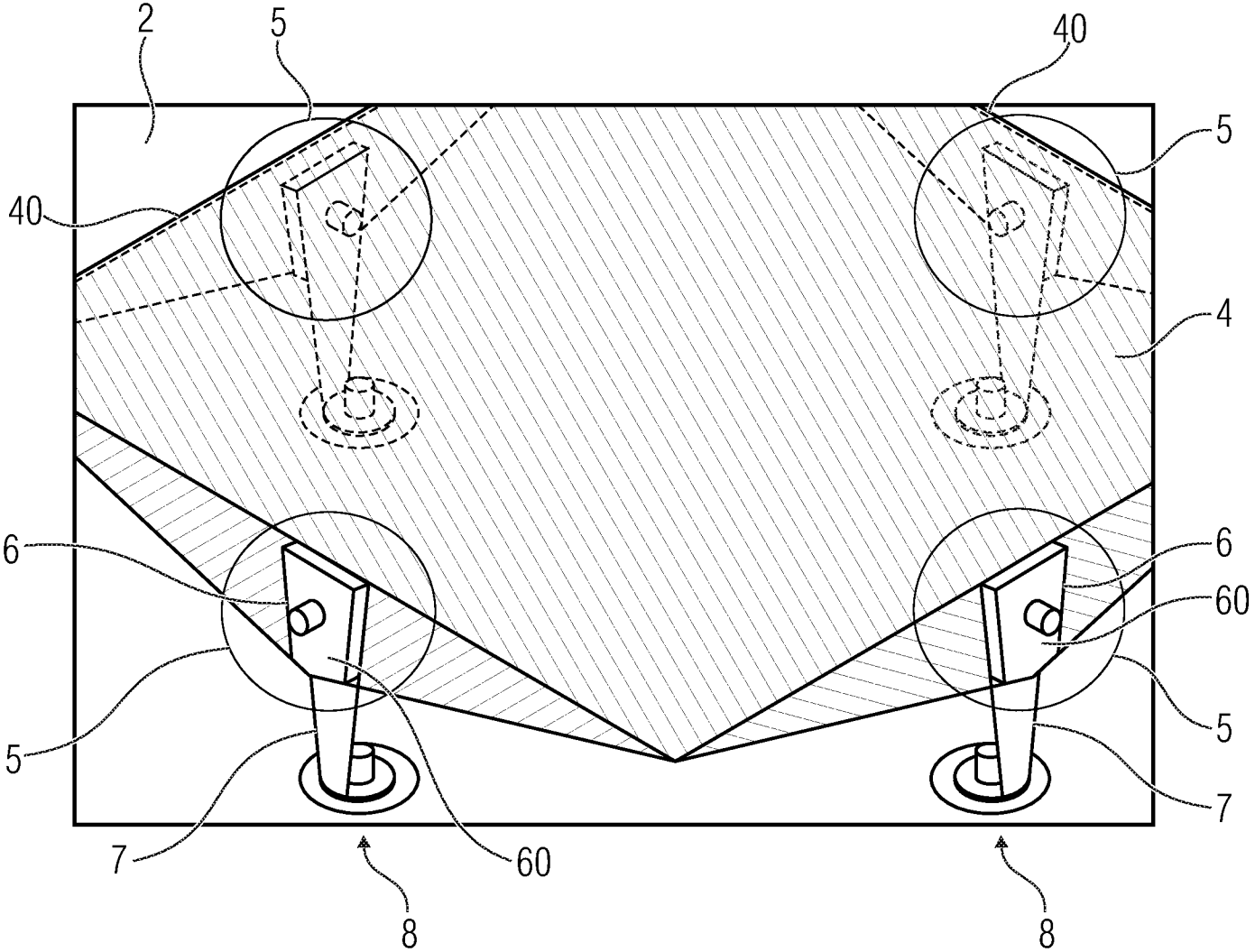
FIG. 2 shows an enlarged cutout of the antenna device of FIG. 1.

The area circled in FIG. 1 is depicted on a larger scale in FIG. 2. What can be seen are the four blade elements 6, which are located on the sides 40 of the emitter element 4, which here is quadrangular, and which have coupling points 5 for capacitive coupling at their free ends 60. Four bridge elements 7 emanate from the carrier element 2 at the four feeding points 8. The bridge elements 7 and the blade elements 6 join at the coupling points 5, where they effect capacitive coupling.

Figure 3:
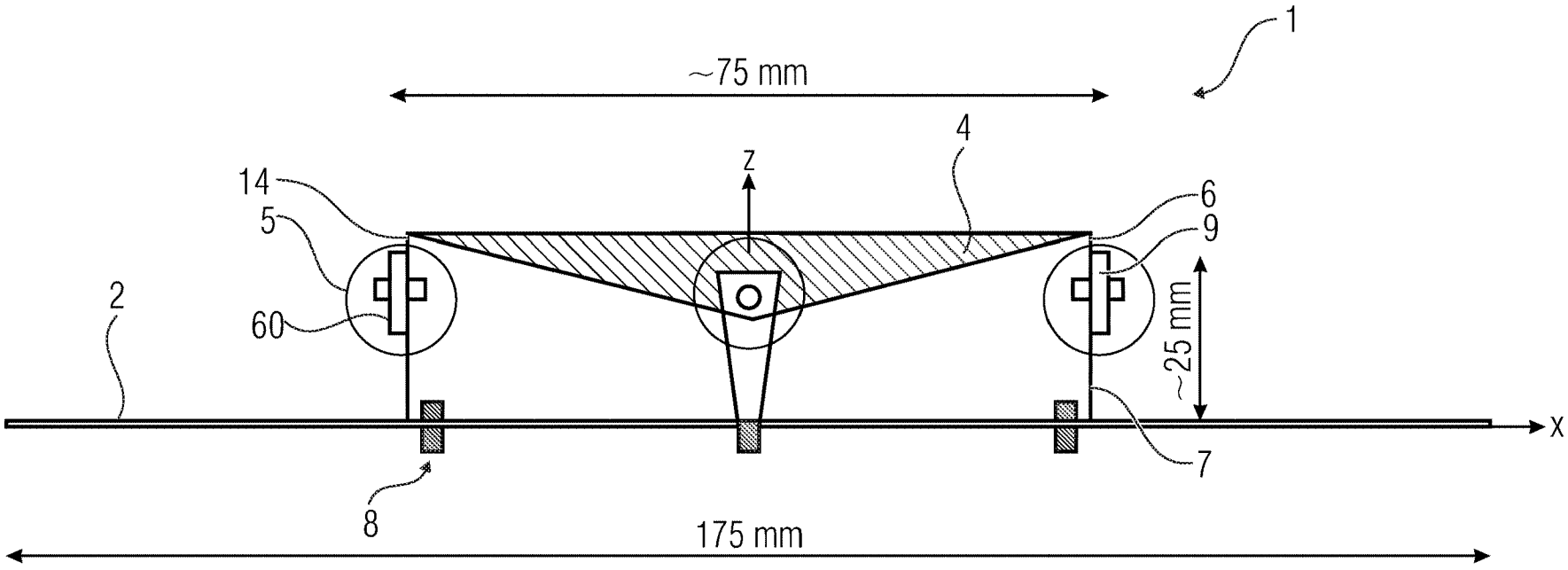
FIG. 3 shows a section through the antenna device of FIG. 1.

The section of FIG. 3 also shows how the emitter element 4 exhibits a central dip toward the carrier element 2. One can further see that the blade elements 6 and, thus, the coupling points 5 are located on the sides 40 of the emitter element 4, which here is quadrangular. Just like the emitter element 4, the blade elements 6 are implemented as metal sheets and are coupled, in particular galvanically, to the emitter element 4. In between the blade elements 6 and the bridge elements 7, an intermediate medium 9 is located in the coupling area 5 in each case, said intermediate medium 9 here being configured as a dielectric and therefore also having an impact on capacitive coupling and enabling fastening of the emitter element 4, at a defined distance, between the blade element 6 and the bridge element 7. In addition, the bridge elements 7 here are galvanically coupled, at the feeding points 8, to the conductive pattern on the carrier element 2. The blade elements 6 and the emitter element 4, or its outer border, form an angle 14, which here is a 90° angle. The blade elements 6 here face the carrier element 2 while also facing away from the upper side of the emitter element 4.

Figure 4:
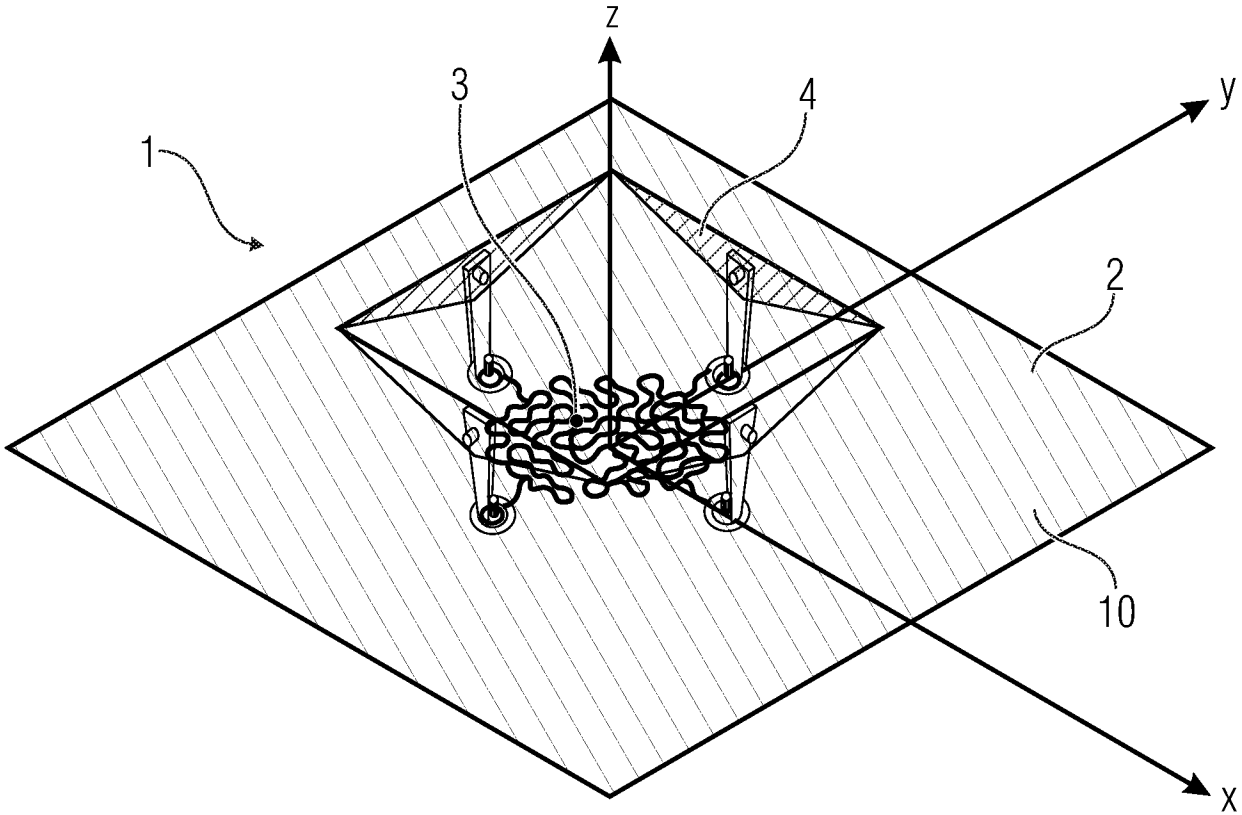
FIG. 4 shows a further spatial and partly transparent representation of the first implementation of an antenna device.

The conductive pattern 3 in the form of conductive tracks on the carrier element 2 is shown in FIG. 4. The conductive pattern 3 is located below the emitter element 4 and on the opposite side of the ground surface area 10, i.e., below the carrier element 2. In an alternative implementation, the ground surface area 10 is located below the carrier element 2, and the conductive pattern 3 is located above the carrier element 2. In a multi-layer architecture, the ground surface area 10 or the conductive pattern 3 are located within any number of layered carrier elements 2. The bridge elements 7 or possibly existing elements which connect the conductive pattern 3 to the bridge elements 7 therefore project through the carrier element 2, depending on the implementation.

FIGS. 1 to 4 thus show the novel capacitive coupling of the emitter element 4 by using the example of patch having four feeding points. By combining capacitive coupling and feeding at four suitably selected points of the emitter element 4 it is possible for the emitter element 4 to be readily matched to a desired impedance, frequently 50 ohm, without involving a large ground surface area 10 and/or a reflector.

The coupling points 5 are located on the sides 40 of the emitter element 4. To this end, the blades (or blade elements 6) are mounted on the sides of the emitter element 4 and are bent downward. Four bridges—one bridge (e.g., bridge element 7) for each feeding point 8—project from the carrier circuit board 2 and are capacitively coupled to the blades 7 via an intermediate medium 9. Consequently, one may reduce the width of the coupling gap between the bridge 7 and the blade 6 while additionally enabling a defined distance between the bridge 7 and the blade 6. As an alternative to the dielectric material present between the bridge 7 and the blade 6, an air gap may also be provided. The emitter element 4 and/or the blade elements 6 may be fastened, by way of supplementation, to the bridges 7, e.g., they may be screwed to, plugged onto, bonded or soldered to the intermediate medium located between the bridge 7 and blade 6. Because of the width, height, and the distance of the coupling point 5, almost any kind of impedance matching is possible, which clearly simplifies development of the antenna element 1 since no lossy matching network is required.

The shape of the emitter element 4 as well as the capacitive coupling points 5 generate high field strengths at the coupling points 5, where the major part of the supplied energy is concentrated. This forces the emitter 4 to have a broad electric aperture, as a result of which the lateral dimensions of the emitter 4 may be clearly reduced.

Figure 5:
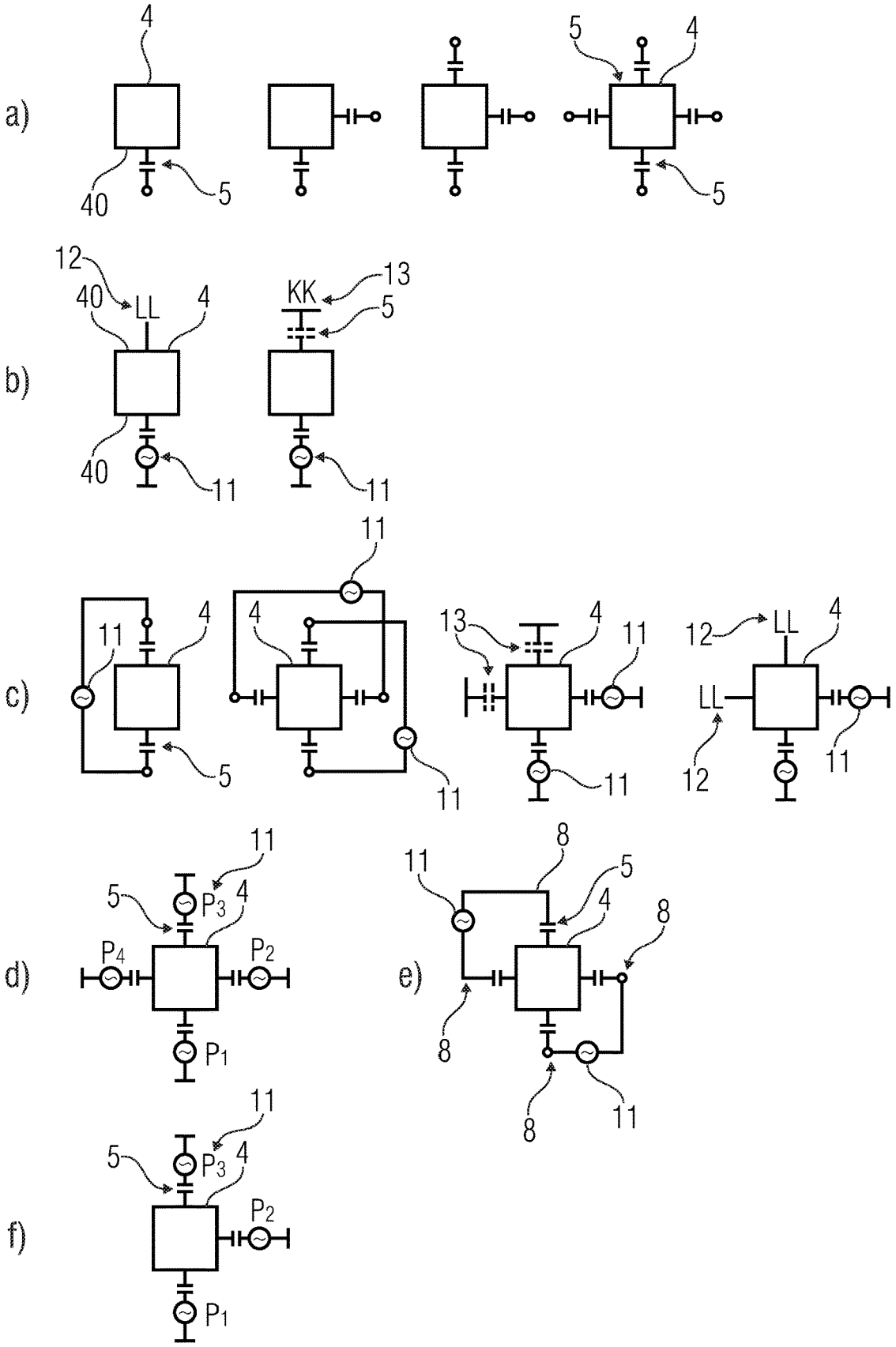
FIG. 5 shows several schematic diagrams for illustrating control of the antenna device.

Coupling via the coupling points 5 on the sides of the respective emitter element 4 may be configured differently. FIG. 5 shows several variants by way of example.

What are shown are different implementations of the architecture, the description being from the left to the right:

a) Different numbers of feeding and/or coupling points 5: There may be only one coupling point 5, several coupling points 5 or here, by way of example, up to four coupling points 5. The number of coupling points 5 may also exceed four. This depends on the geometry of the emitter element 4. In the implementations shown here, capacitive coupling takes place across all coupling points 5.

b) With an oppositely located open circuit (LL, 12) or short circuit (KK, 13) and a connection to a voltage source 11, which here is also to serve as a signal source for the electromagnetic signals to be emitted.

The points of contact alternatively are present on adjacent sides 40. The connections to an open circuit 12 and/or a short circuit 13 which are shown here are alternatively effected by means of capacitive coupling and/or by a capacitor (lumped component).

c) Examples of linear polarization.

The variants are as follows (from the left to the right):

Linear polarization of the emitter element 4 across two mutually opposite capacitive coupling points 5 and the connection to a signal source 11. Dual linear polarization with four coupling points 5 and two signaling sources 11.

Dual linear polarization with a short circuit 13 on a side of the emitter element 4 which is located opposite the coupling point 5 for coupling to a signal source 11.

Alternatively, capacitive coupling and/or a capacitor (lumped component) is also used. Dual linear polarization with the open circuit 11.

d) Circular polarization with four coupling points 5 and four signal sources 11.

e) Dual circular polarization with four coupling points 5 and two signal sources 11 each of which comprises two feeding points 8. The feeding points 8 of a signal source 11 are contacted to adjacent coupling points 5, respectively.

f) Elliptical polarization with three capacitive coupling points 5 and three signal sources 11.

Figure 6:
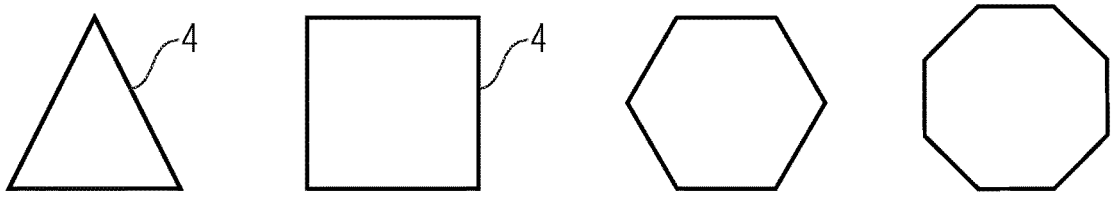
FIG. 6 shows several schematic diagrams for illustrating the geometry of the emitter element.

The emitter element 4 may be shaped or configured differently. By way of example, FIG. 6 shows some variants. What is shown is an n-gonal emitter element 4, respectively, whose outer contour is formed by the n-exon. n is a natural number larger than three.

Figure 7:
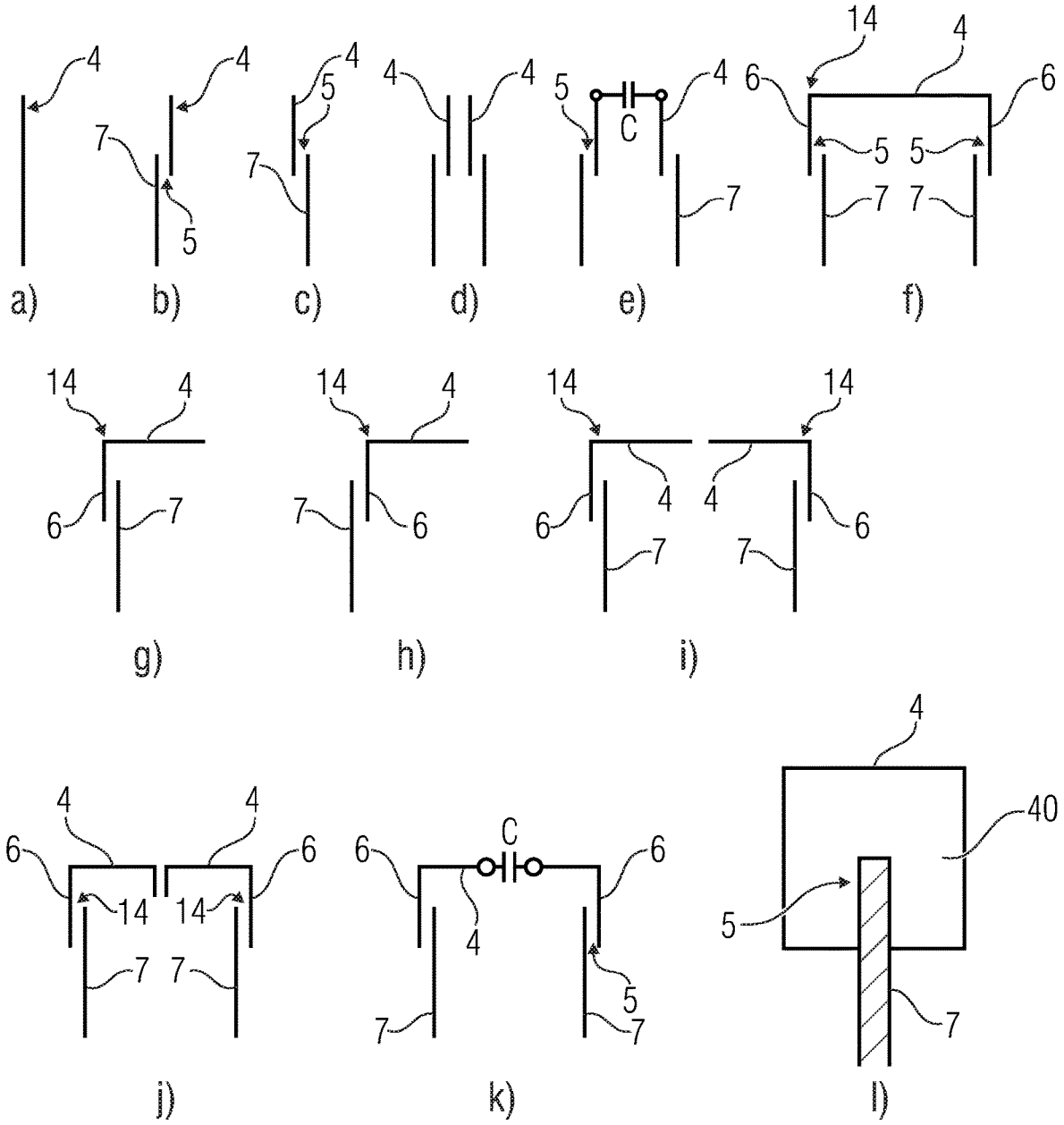
FIG. 7 shows several schematic diagrams for illustrating capacitive coupling of an emitter element.

FIG. 7 shows variants comprising a monopole as an implementation of the emitter element 4. Moreover, different variants for coupling to bridge elements 7 are depicted. In some of the implementations, no blade elements are present, so that the emitter element 4 comprises the at least one coupling point directly on a side 40. The variants of FIGS. 7 *a*) to *e*) and *l*) comprise only the emitter element 4 and the bridge element 7. Variants of FIGS. 7 *f*) to *k*) comprise the emitter element 4, at least one blade element 5, and at least one bridge element 7.

The following implementations are shown in FIG. 7;

a) simple monopole 4 with coupling at the feeding substrate.

b) monopole 4 comprising capacitive coupling to the bridge element 7 from the left, c) monopole 4 comprising capacitive coupling from the right, d) two monopoles 4 forming a dipole and being dually coupled in a capacitive manner, e) two monopoles 4 capacitively coupled to each other at the monopole ends and capacitively coupled to the bridge elements 6 via the coupling points 5, and f) short circuit of two capacitively coupled monopoles 4, which results in a dipole or patch. The laterally mounted blade elements 6 are angulated in the direction of the bridge elements 7 at an angle 14 of 90°.

g) angulated monopole 4 (also comprising angulation 14) comprising capacitive coupling from the right to a bridge element 6, h) angulated monopole 4 comprising capacitive coupling from the left, i) monopole 4 (=dipole) that is dually coupled in a capacitive manner, j) dual capacitively coupled monopole 4 (=dipole) comprising capacitive coupling of the emitter elements, k) dual capacitively coupled monopole 4 (=dipole) comprising a capacitor (lumped component) between the emitter elements 4.

Instead of monopoles in the form of wires or, coaxial cables, the emitter elements 4 are, in alternative implementations, surface emitters, e.g., in the form of broad metal-sheet elements. This is shown by FIG. 7 *l*), which allows a view, twisted by 90°, of the implementation of FIG. 7 *b*). The side 40 of the emitter element 4 here is defined by the floor space. The bridge element 7, which is configured as a strip here, is capacitively connected, on this side 40, to the emitter element 4 via the coupling point 5.

Figure 8:
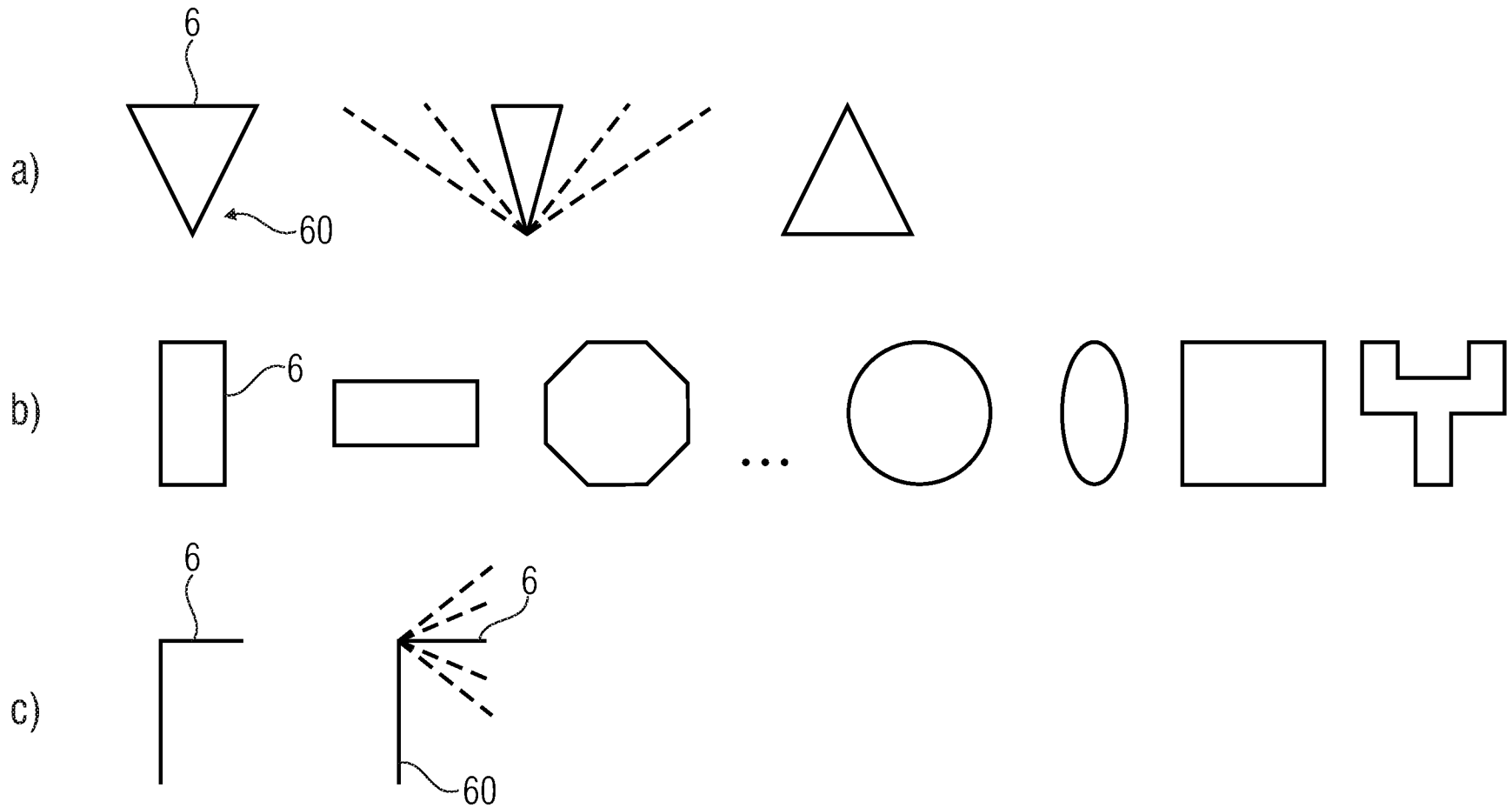
FIG. 8 shows several schematic diagrams for illustrating the geometry of the blade elements.

The blade elements 6 on the emitter element 4 may also be implemented differently. FIG. 8 shows some variants by way of example (the descriptions are again from the left to the right):

a) triangular blade element 6 comprising any internal angles <180°;

b) n-gon with n≥3 up to a circular or elliptical blade element 6 or a shape that is similar to a T-piece (extreme right)

c) blade elements 6 of any type of angulation whose connection to the emitter element—not shown here—would be at the right end in each case. The free ends 60 each have the coupling points located thereat, and the ends—which, depending on the implementation, are located opposite the free ends—have the blade elements 6 located thereat which are connected to the respective emitter element.

Just like the blades 6 on the emitter element 4, the bridges 7 may also be configured differently. They may vary in width, height, thickness and shape. In addition, they may be straight or angulated. In addition to air, an intermediate medium 9, e.g., dielectrics, ferrites, ferroelectrics and others, may be inserted between the emitter element 4 and the feeding circuit board 2. Fastening of the bridge elements 7 on the feeding circuit board as an example of the carrier element 2 may be implemented differently, just like fastening of the emitter element 4 on the bridge elements 7, e.g., the bridge elements 7 may be screwed on, plugged, bonded or soldered.

Figure 9:
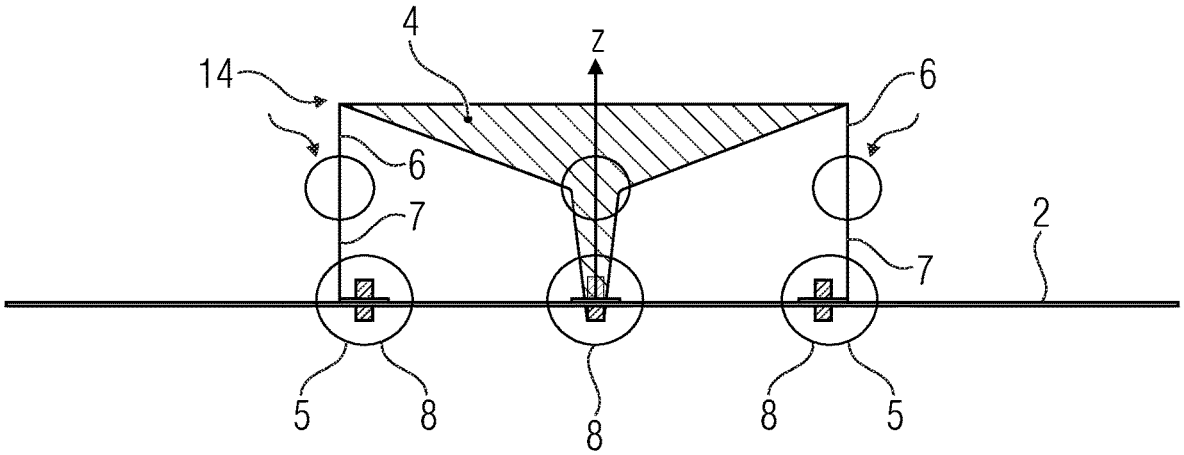
FIG. 9 shows a section through a second implementation of an antenna device.
Figure 10:
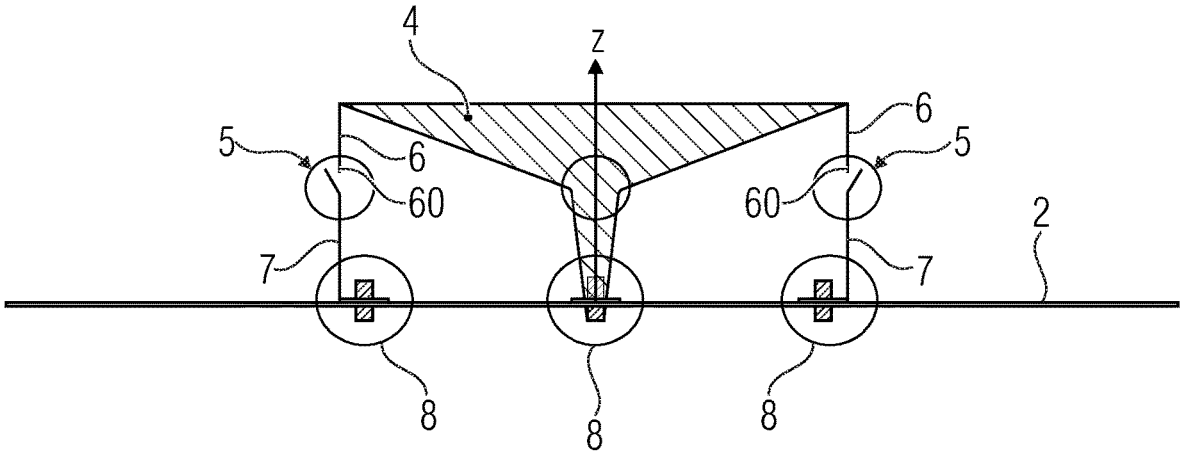
FIG. 10 shows a section through a third implementation of an antenna device.

The illustrations FIG. 9 and FIG. 10 show two further embodiments comprising four points for capacitive coupling between the conductive pattern on the carrier element 2 and the emitter element 4.

At the feeding points 8, respectively, capacitive coupling takes place between the conductive pattern on the carrier element 2 and the bridge elements 7. The blade elements 6 are located on the sides of the n-gonal emitter element 4 and are bent in the direction of the carrier element 2.

In the implementation of FIG. 9, there is galvanic coupling between the bridge elements 7 and the blade elements 6 in the areas demarcated by circles and arrows. In this variant, the coupling points 5 for capacitive coupling are therefore located in the area of the feeding points 8. The blade elements 6 and the bridge elements 7 are galvanically coupled to one another or designed to be integral, depending on the implementation. In the latter variant, therefore, the blade elements 6 end up with their coupling points 5 on the free ends 60 on the carrier element 2.

In the implementation of FIG. 10, there is capacitive coupling—here, in particular, via an air gap—between the bridge element 7 and the blade element 6, so that between same, there is also the capacitive coupling point 5. Capacitive coupling continues to exist between the bridge element 7 and the feeding point 8. This is in contrast to the galvanic coupling between the blade elements 6 and the emitter element 4. The blade elements 6 here may also be seen as sheet metal strips which are attached to the sides of the emitter element 4 and are bent downward. Also, one may see that across the implementations of blade elements 6 and bridge elements 7, the distance between the emitter element 4 and the carrier element 2 or, e.g., a ground surface area on the carrier element 2 is adjustable.

In one implementation, the at least one emitter element 4 is made of sheet metal, the blade elements 6 and the bridge elements 7 also consisting of sheet metal.

The illustrations of FIG. 11 to FIG. 14 show a further implementation of the antenna device 1 comprising two emitter elements 4, 4'. This is a "stacked patch", for example, e.g. for dual-band design or for expanded broadband design.

Figure 11:
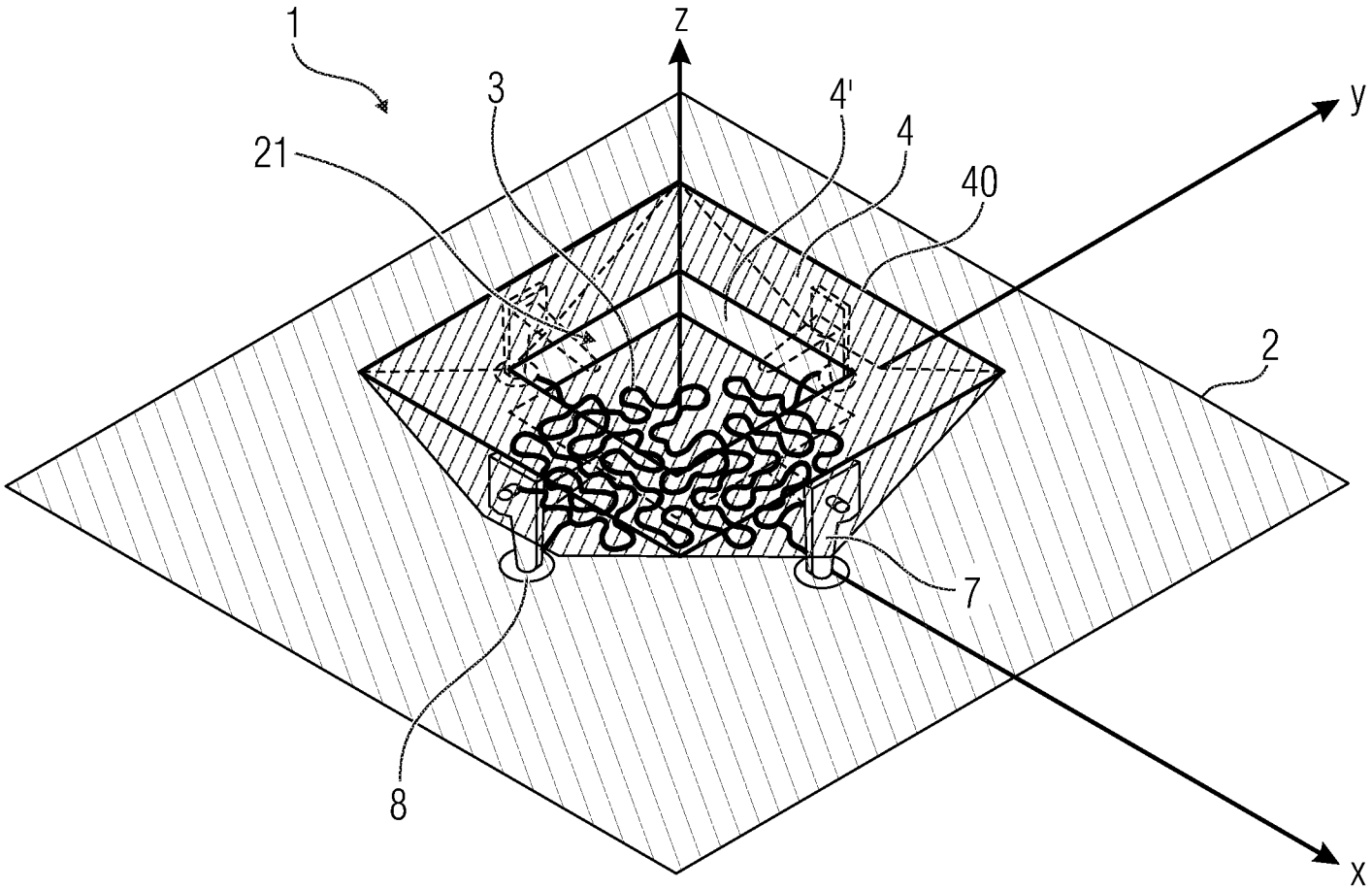
FIG. 11 shows a spatial and party transparent representation of a fourth implementation of an antenna device.

FIG. 11 shows the two emitter elements 4, 4', which are implemented differently and are both spaced apart from the carrier element 2. The emitter element 4 (also: first emitter element) which is located at a higher level comprises a quadrangular outer contour and a central quadrangular recess 21. Other outer contours are also possible. The second emitter element 4' is located inside the recess 21 and is closer to the carrier element 2. In the implementation shown, the second emitter element 4' is also configured to be quadrangular. Both emitter elements 4, 4' are implemented to be planar here and are located essentially in parallel to the carrier element 2. One can recognize the conductive pattern 3 in the form of conductive tracks on the carrier element 2 having the four feeding points 8, to each of which a bridge element 7 is connected. This is in line with the four coupling points 5 at the blade elements 6 on the four outer sides 40 of the upper emitter element 4.

Figure 12:
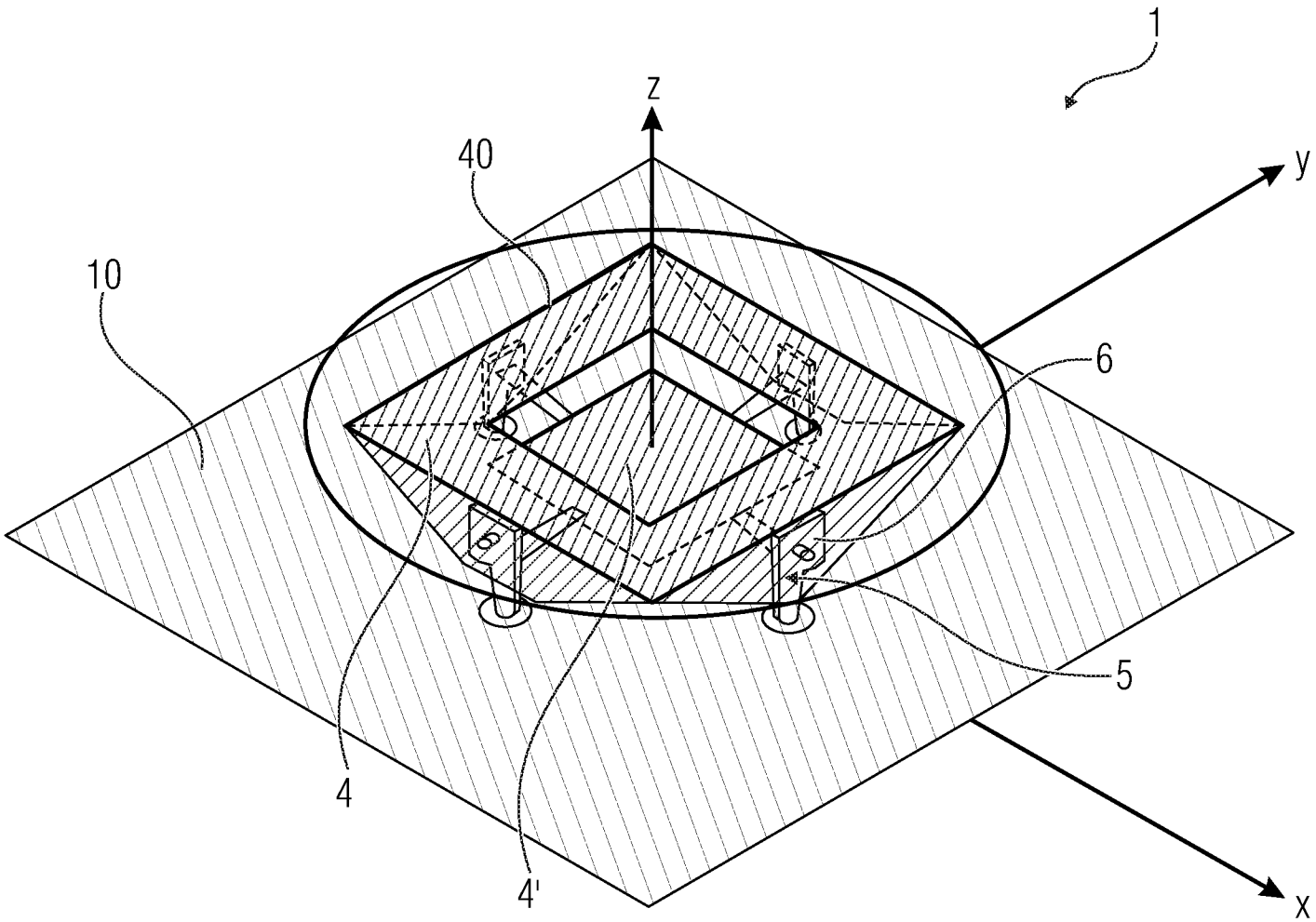
FIG. 12 shows a further spatial and partly transparent representation of the fourth implementation of an antenna device.

In FIG. 12 one may see the different implementations of the two emitter elements 4, 4' and their mutual arrangements. One can also see that the blade elements 6 are located on the sides 40 of the upper, or first, quadrangular emitter element 4 and project in the direction of the carrier element 2 from there. Therefore, the capacitive coupling points 5 are also located on the sides. One may also see the planar progress of the blade elements, which start from the sides of the upper emitter element 4 and are angulated here in the direction of the carrier element 2.

Figure 13:
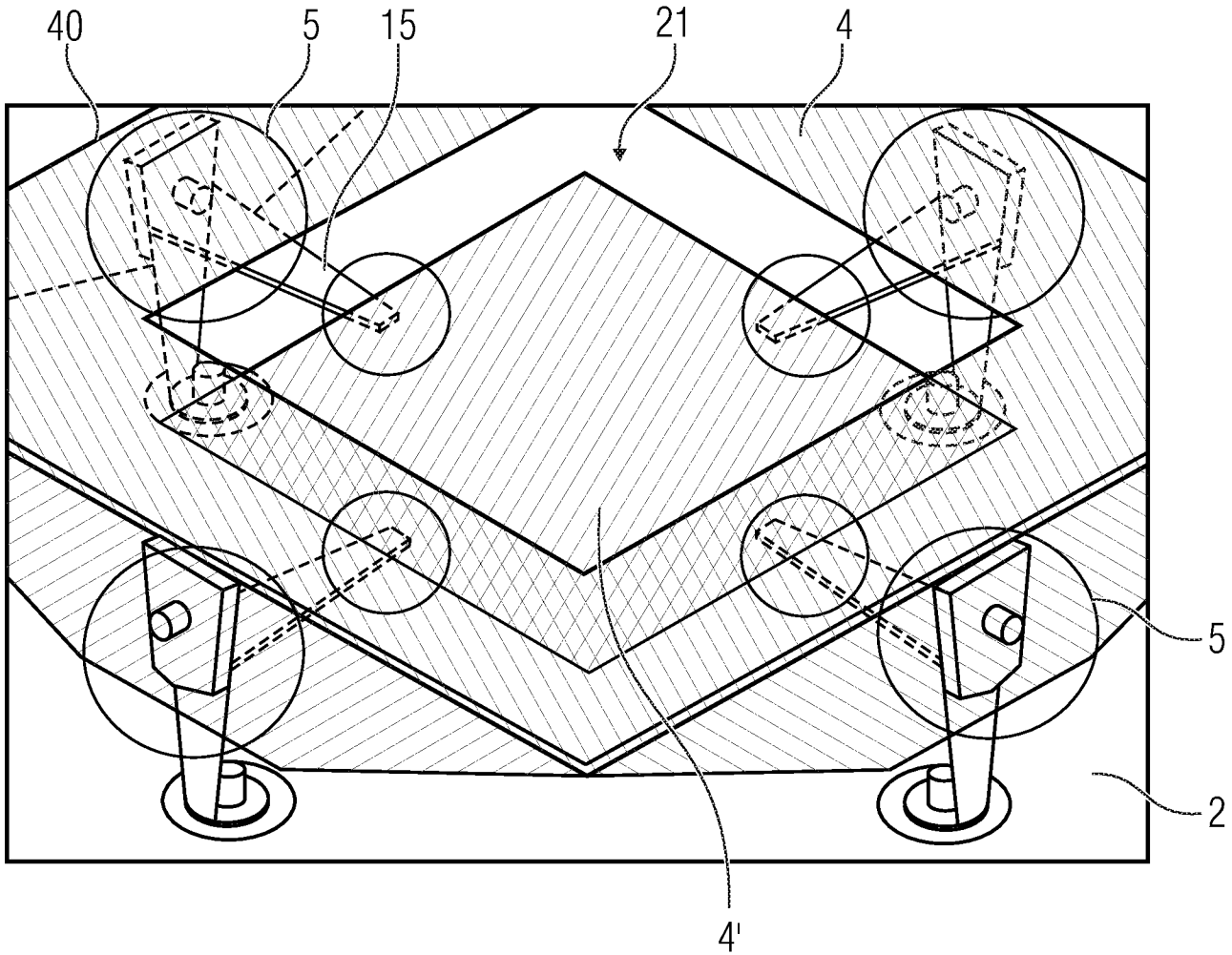
FIG. 13 shows an enlarged cutout of the antenna device of FIG. 11 and FIG. 12.

FIG. 13 shows the enlarged cutout of the part of the antenna device 1 of FIG. 12. Tongue elements 15 project from the coupling points 5 to the emitter element 4' which is located further in the direction of the carrier element 2, and therefore also generate electric here, in particular capacitive—coupling to said—second—emitter element 4'. In total, therefore, the two emitter elements 4, 4' are capacitively coupled to each other, and one of the two emitter elements 4 is capacitively coupled to the conductive pattern 3 via the blade elements 6.

The section of FIG. 14 once again shows that the upper—first—emitter element 4 rests on the carrier element 2 via the connection of laterally located blade elements 6 and bridge elements 7 and is capacitively coupled—via the coupling points 5—to the feeding points 8. A dielectric is interposed, as an intermediate medium 9, between the bridge elements 7 and the blade elements 6. The tongue elements 15, which also cause electric and, here, capacitive contacting, extend in the direction of the lower—second—emitter element 4'.

Figure 14:
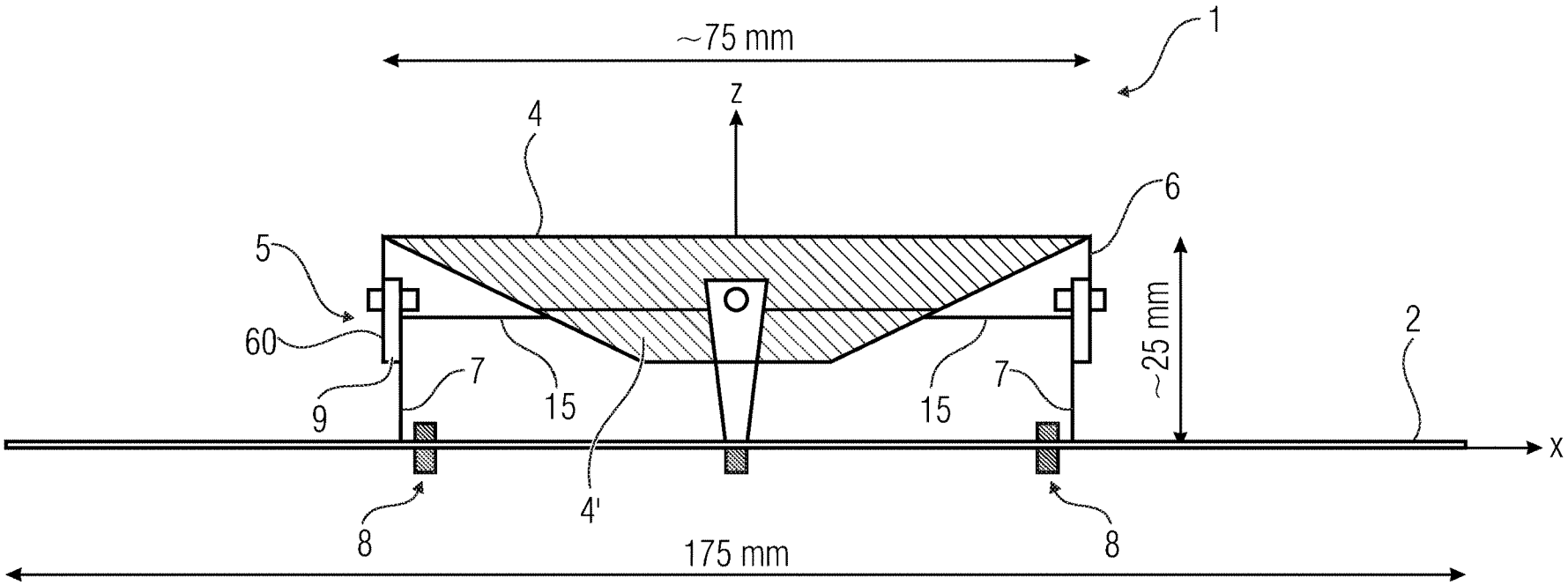
FIG. 14 shows a section through the antenna device of FIG. 11 and/or FIG. 12.

Additionally, FIG. 14 has also plotted therein that the carrier element 2 has a width of 175 mm and that the upper emitter element 4 has a side length of 75 mm. The outer contour, which here is quadrangular, in particular, of the upper emitter element 4 is located about 25 mm above the carrier element 2.

Capacitive coupling of at least one emitter element at—advantageously four—points provides the following advantages:

a) The lateral dimensions of the emitter element may be clearly smaller than half the wave length at the operating frequency. Thus, dimensions of a quarter of the wavelength or less are possible.

b) The effective aperture of the emitter element is larger than the lateral extension since the shape of the emitter and the associated position of the coupling points cause a high concentration of the energy, or field strength, at the coupling points.

c) Simple, low-loss impedance matching is possible.

d) Despite the small volume dimensions, it enables a large relative bandwidth, both for impedance matching and for the directional characteristic.

e) No large ground area surface and/or reflector is required for reducing back reflection. The diameter of the ground surface area may be half a wavelength or smaller, for example.

f) The emitter element may be designed to be very low in cost since no expensive substrates such as ceramics are required. In the simplest case, stamping and bending parts made of sheet metal (e.g. aluminum) are sufficient.

g) Very small design height, which promotes utilization for flat antennas, e.g. for UHF RFID applications.

One technical field of application is enabled, e.g., by UHF RFID antennas for utilization in logistics, production or automation. This includes, for example, gate passages and others including bulk reading (sensing of many transponders within a short time), automated stocktaking or identity checks (e.g. in health care). A further possibility of application is offered by mobile terminals for satellite or terrestrial mobile communication. Further applications are in the field of automotives and/or in the field of networking between vehicles or road users (so-called Car2X).

The above-described embodiments merely represent illustrations of the principles of the present invention. It is understood that modifications and variations of the arrangements and details described herein will be appreciated by other persons skilled in the art. This is why it is intended for the invention to be limited merely by the scope of the following claims rather than by the specific details presented herein by means of the descriptions and illustrations of the embodiments.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] A. E. Popugaev and R. Wansch, "A novel miniaturization technique in microstrip feed network design," in Proc. of the 3rd European Conference on Antennas and Propagation, EuCAP 2009, Berlin, March, 2009, pp, 2309-2313.

[2] A. E. Popugaev, R. Wansch, S. Urquijo, "A NOVEL HIGH PERFORMANCE ANTENNA FOR GNSS APPLICATIONS," in Proc. of the 2nd Second European Conference on Antennas and Propagation (EuCAP), Edinburgh, UK, Nov. 11-16, 2007.

[3] L. Weisgerber and A. E. Popugaev, "Muitibeam antenna array for RFID applications," in Proc. of the 2013 European Microwave Conference (EuMC), Nuremberg, October 2013, pp. 84-87.

The invention claimed is:

1. An antenna device comprising:
comprising an emitter element for emitting and/or receiving electromagnetic signals,
wherein the emitter element comprises at least one coupling point,
the coupling point being connected to a side of the emitter element,
wherein the coupling point is implemented for capacitively coupling electromagnetic signals in and/or out,
wherein said antenna device comprises a conductive pattern for conducting electromagnetic signals, and
wherein the conductive pattern and the emitter element are capacitively coupled to each other via the coupling point,
wherein the emitter element comprises at least one blade element,
wherein the emitter element and the blade element are galvanically coupled to each other,
wherein the blade element is arranged on the side of the emitter element,
wherein the emitter element and the blade element form an angle with each other, and
wherein the blade element comprises the coupling point,
wherein said antenna device comprises at least one bridge element,
wherein the bridge element is galvanically or capacitively coupled to a feeding point of the conductive pattern,
wherein the bridge element and the emitter element are capacitively coupled to each other via the coupling point,
wherein the antenna device comprises a carrier element,
wherein the blade element is bent from the emitter element in the direction toward the carrier element, and
wherein the coupling point is located at a free end of the blade element.

2. The antenna device as claimed in claim 1,
wherein an intermediate medium is located in the area of the coupling point and wherein capacitive coupling is effected via the intermediate medium.

3. The antenna device as claimed in claim 1,
wherein the emitter element is attached at a distance from the carrier element.

4. The antenna device as claimed in claim 1,
wherein the emitter element is configured as a surface emitter.

5. The antenna device as claimed in claim 4,
wherein the emitter element is implemented as a surface emitter exhibiting an outer contour in the form of an n-gon, and
wherein n is a natural number larger than or equal to three.

6. The antenna device as claimed in claim 4,
wherein the emitter element is implemented as a funnel-shaped surface emitter exhibiting a central dip.

7. The antenna device as claimed in claim 5, wherein the coupling point is arranged centrally in the area of a side of the n-gon of the emitter element.

8. The antenna device as claimed in claim 4, wherein the emitter element is implemented as a metal sheet.

9. The antenna device as claimed in claim 4, wherein the emitter element is implemented as a monopole.

10. The antenna device as claimed in claim 1, wherein the conductive pattern is mounted on the carrier element.

11. The antenna device as claimed in claim 1, wherein the carrier element has a ground surface area located thereon.

12. The antenna device as claimed in claim 1, wherein the emitter element comprises coupling points on several sides, and wherein the emitter element is capacitively coupled to the conductive pattern via at least one coupling point.

13. The antenna device as claimed in claim 12, wherein the emitter element is capacitively coupled to the conductive pattern via more than one coupling point.

14. The antenna device as claimed in claim 1, wherein the emitter element comprises four coupling points.

15. The antenna device as claimed in claim 14, wherein the emitter element is capacitively coupled to the conductive pattern via the four coupling points.

16. The antenna device as claimed in claim 12, wherein the emitter element is connected to a signal source via at least one coupling point.

17. The antenna device as claimed in claim 12, wherein the emitter element is connected to an open circuit via at least one coupling point, so that there is an open end.

18. The antenna device as claimed in claim 12, wherein the emitter element is connected to a short circuit via at least one coupling point.

19. An antenna device comprising:

an emitter element for emitting and/or receiving electromagnetic signals, wherein the emitter element comprises at least one coupling point, the coupling point being connected to a side of the emitter element, wherein the coupling point is implemented for capacitively coupling electromagnetic signals in and/or out, wherein the antenna device comprises at least two emitter elements, and wherein the two emitter elements are coupled to each other, in particular capacitively or galvanically.

20. The antenna device as claimed in claim 19, wherein the two emitter elements exhibit different distances from the carrier element.

21. The antenna device as claimed in claim 19, wherein an emitter element of the two emitter elements comprises a recess and wherein another emitter element of the two emitter elements is arranged in the area of the recess.

* * * * *